US005762722A

United States Patent [19]

Zhang

[11] Patent Number: 5,762,722

[45] Date of Patent: Jun. 9, 1998

[54] COVERING FLUX FOR SMELTING ALUMINUM AND A PROCESS FOR ITS PREPARATION

[76] Inventor: Zongiiang Zhang, FL. 2, Bldg. 1, Harbin High Technology Development Zone, Heilongiiang, 1500036, China

[21] Appl. No.: 676,273

[22] PCT Filed: Nov. 17, 1995

[86] PCT No.: PCT/CN95/00090

§ 371 Date: Oct. 28, 1996

§ 102(e) Date: Oct. 28, 1996

[87] PCT Pub. No.: WO96/16192

PCT Pub. Date: May 30, 1996

[30] Foreign Application Priority Data

Nov. 18, 1994 [CN] China ..... 94 1 18486.2

[51] Int. Cl.[6] ..... C22B 21/00

[52] U.S. Cl. ..... 148/26; 148/23; 75/315; 75/314; 75/313; 75/303

[58] Field of Search ..... 148/23, 26; 75/315, 75/314, 313, 303

[56] References Cited

U.S. PATENT DOCUMENTS

| | | | |
|---|---|---|---|
| 3,321,829 | 5/1967 | Scott | 29/495 |
| 3,769,001 | 10/1973 | Valdo et al. | 75/68 R |
| 3,793,007 | 2/1974 | Kline et al. | 75/134 |
| 4,261,746 | 4/1981 | Langston et al. | 75/257 |
| 4,451,287 | 5/1984 | Bauer et al. | 75/24 |
| 4,564,393 | 1/1986 | Murray et al. | 75/256 |
| 4,568,430 | 2/1986 | Viré | 204/67 |
| 5,405,427 | 4/1995 | Eckert | 75/308 |

FOREIGN PATENT DOCUMENTS

| | | | |
|---|---|---|---|
| 1549979 | 8/1979 | United Kingdom | C22B 21/00 |

*Primary Examiner*—David A. Simmons
*Assistant Examiner*—M. Alexandra Elve
*Attorney, Agent, or Firm*—Harness, Dickey & Pierce, P.L.C.

[57] ABSTRACT

The present invention relates to a highly efficient aluminum covering flux and a process for its preparation. The said covering flux comprises potassium chloride, sodium chloride, lithium chloride, potassium fluoride and sodium hydrosulfate, wherein the composition of the mentioned covering flux is: potassium chloride, 20–65 parts by weight; sodium chloride, 20–65 parts by weight; lithium chloride, 1–20 parts by weight; potassium fluoride, 0.3–5 parts by weight, sodium hydrosulfate, 0.2–3 parts by weight. The said covering flux can effectively prevent the oxidization of aluminum in the process of smelting aluminum and can increase the yield of aluminum.

20 Claims, No Drawings

COVERING FLUX FOR SMELTING ALUMINUM AND A PROCESS FOR ITS PREPARATION

CROSS-REFERENCE TO RELATED APPLICATION

This application is the national phase filing of International Application No. PCT/CN95/00090 filed Nov. 17, 1995, which is hereby incorporated by reference.

TECHNICAL FIELD

The present invention relates to a covering flux for smelting aluminum and a process for its preparation; particularly to a highly efficient covering flux for smelting aluminum which can be used in the re-smelting and reclamation of aluminum waste such as aluminum scraps, aluminum foils, ect., and to a process for the preparation of the covering flux.

BACKGROUND ART

For their unique properties, the metal aluminum and its alloys have been put into wide applications in various aspects of national economy and people's daily life. And with the development of the economy, the worldwide demand on aluminum is increasing year by year. However, on one hand, a large amount of aluminum waste emerges in the process of aluminum processing, e.g., the scraps yielded in the process of turning and milling, etc.; on the other hand, a rather big amount of aluminum waste is also produced because of the abandoned industrial equipments and the consumption of people's daily appliances. In order to re-utilize the aluminum waste, they are reclaimed by being put back into the smelting furnace for re-smelting. However, as aluminum is a rather active and easily oxidized element, the yield ratio will decrease due to the oxidization during the re-smelting process when it is put back into the smelting furnace, and therefore a portion of resources are wasted. In order to prevent the oxidization of waste during the process of re-smelting, usually a layer of protective flux, also called covering flux, is covered on the surfaces of aluminum waste in the process. One widely adopted covering flux for smelting aluminum is a mixture of potassium chloride and sodium chloride with the ratio of 1:1 by weight. The Soviet Patent No. SU571522 (published on 19 Jul., 1974) discloses a process for the treatment of aluminum alloy scraps, wherein the compressed scraps are laid on the base layer of aid-flux (a calcium-barium chloride which is preheated to 800°–1000° C.); then a layer of molten aluminum is laid on the scraps; afterwards a light flux (100–300 mm-thick eutectic mixture of potassium chloride-sodium chloride-cryolite, functioned to prevent the oxidization of aluminum alloy), is laid on the layer of molten aluminum. West German Patent No. DE 2821353 (published on 2 Jun., 1977) discloses a process of reclaiming aluminum from aluminum waste, by recycling the waste aluminum scrap to aluminum melt, and treating the slag with a flux of composition of 40–55 wt. % sodium chloride, 40–55 wt. % potassium chloride and 3–15 wt. % of carbonate, borax of Li, Ba, Mg or Ca. Although these methods can raise the yield of aluminum and aluminum alloys, they have one feature in common, i.e., with both methods, scraps of aluminum or its alloys need to be dipped into molten aluminum, which on one hand, a lot of energy is consumed, on the other hand, under some circumstances, especially when reclaiming aluminum alloy, it will have some difficulties in preparing molten aluminum alloys with same composition as the aluminum alloys to be reclaimed.

The main reason is that the protective function of the existing covering fluxes before the aluminum scrap is molten is too weak, and, instead of adding molten aluminum, if the aluminum scraps are directly heated and molten (commonly known as net feed), violent oxidization will occur before aluminum scraps are molten, thereon the yield decreases.

DISCLOSURE OF THE INVENTION

Therefore, one object of present invention is to provide a covering flux for smelting aluminum, and as this covering flux will also have a good protective function before aluminum scraps are molten, the yield of aluminum will rise; even under the circumstance of net feed, a rather high yield can also be achieved with rather good economical profits.

The second object of present invention is to provide a method for preparing said covering flux for smelting aluminum.

The covering flux for smelting aluminum according to present invention comprises: potassium chloride, sodium chloride, lithium chloride, potassium fluoride, sodium hydrosulfate.

According to one preferred embodiment of present invention, potassium fluoride in the covering flux is the dihydrate of potassium fluoride, and/or sodium hydrosulfate is the monohydrate of sodium hydrosulfate.

It should be understood that besides the components mentioned above, the covering flux for smelting aluminum can also comprise small quantity of conventional additives that are well-known in the art, e.g., the covering flux for aluminum alloy containing magnesium can comprise a small quantity of barium chloride, magnisum chloride; the covering flux for aluminum alloy containing zinc can include a small quantity of zinc chloride; and to improve the separation of aluminum from slag, a small quantity of cryolite and calcium fluoride can be added into the covering flux; etc.

According to one embodiment of present invention, the composition (parts by weight) of the said covering flux for smelting aluminum is: potassium chloride 20–65, sodium chloride 20–65, lithium chloride 1–20, potassium fluoride 0.3–5 and sodium hydrosulfate 0.2–3.

According to another embodiment of present invention, the composition (parts by weight) of said covering flux for smelting aluminum is: potassium chloride 40–55, sodium chloride 30–45, lithium chloride 3–20, potassium fluoride 1.5–5 and sodium hydrosulfate 0.5–3.

According to one preferred embodiment of present invention, the composition (parts by weight) of the said covering flux for smelting aluminum is: potassium chloride 48–52, sodium chloride 38–42, lithium chloride 5–7, potassium fluoride 2–3 and sodium hydrosulfate 1–1.5.

The said covering flux for smelting aluminum of present invention can be prepared by a process comprising the following steps: (1) each component of the said covering flux, i.e., potassium chloride, sodium chloride, lithium chloride, potassium fluoride, sodium hydrosulfate, is measured individually by a bench scale on the basis of weight; (2) the three components, potassium chloride, sodium chloride, lithium chloride, are dried at a temperature lower than 300° C.; (3) three dried components are ground, preferably screened through an 80-mesh sieve, and homogeneously mixed with each other; (4) the component of potassium fluoride is ground and mixed homogeneuously with the mixture prepared by step (3); (5) sodium hydrosulfate is ground, preferably until its size is below 80 mesh, and then homogeneously mixed with mixture prepared by step (4).

According to one embodiment of present invention, the said covering flux for smelting aluminum of present invention can also be prepared by a process comprising the following steps: (1) each component of the said covering flux, i.e., potassium chloride, sodium chloride, lithium chloride, potassium fluoride, sodium hydrosulfate, is measured individually by a bench scale on the basis of weight; (2) the three components, potassium chloride, sodium chloride, lithium chloride, are dried at a temperature lower than 300° C.; (3) three dried components are ground, preferably screen through an 80-mesh-sieve, and homogeneously mixed with each; (4) potassium fluoride is dissolved into water to form an aqueous solution, preferably a saturated aqueous solution and mixed homogeneously with the mixture prepared by step (3) by spraying and stirring; (5) sodium hydrosulfate is dissolved into water to form an aqueous solution and mixed homogenously with the mixture prepared by step (4). In this method, the step (5) can also be: sodium hydrosulfate is ground and homogeneously mixed with mixture prepared by step (4).

According to one variant of present invention, after the preparation of homogenous mixture of three components of potassium chloride, sodium chloride and lithium chloride, the ground sodium hydrosulfate is added first and homogeneously mixed with said mixture, and then the ground potassium fluoride is added and homogeneously mixed with existing mixture. Thereafter the covering flux for smelting aluminum of present invention is prepared.

According to another variant of present invention, after the preparation of homogenous mixture of three components of potassium chloride, sodium chloride, lithium chloride, the aqueous solution of sodium hydrosulfate, preferably a saturated aqueous solution, is added and homogeneously mixed with said mixture, and then the aqueous solution of potassium fluoride, preferably a saturated aqueous solution, is added and homogeneously mixed with the existing mixture of four components by spraying and stirring. Thereafter, the covering flux for smelting aluminum of present invention is prepared. In this embodiment, instead of preparing an aqueous solution, the ground potassium fluoride can also be added directly.

Compared with current covering flux for smelting aluminum, the covering flux for smelting aluminum of present invention includes lithium chloride, potassium fluoride and sodium hydrosulfate in addition to potassium chloride and sodium chloride. Therefore, on one hand, as the melting point of the covering flux is lowered, a liquid phase formed at a rather low temperature will prevent the aluminum scraps from being oxidized; and on the other hand, as a lot of protective gases are produced during the heating of the flux and these gases will react with aluminum oxide forming a protective film on the surface of aluminum and its alloys; the protective film will prevent the oxidization of aluminum and its alloys by effectively insulating them from the air. Therefore the said covering flux for smelting aluminum has a very good protective function. As a result, the yield of aluminum increases; even under the circumstance of net feed, a rather high yield can still be obtained with rather high economic profits. Further, because of the abundance of the raw materials, simple technical requirement and low costs, the covering flux for smelting aluminum can be widely applied in the smelting process of metal aluminum and its alloys.

BEST MODE FOR CARRYING OUT THE INVENTION

The covering flux for smelting aluminum and its preparation methods of present invention will be explained with reference to the following examples. The potassium chloride, sodium chloride, lithium chloride, potassium fluoride, sodium hydrosulfate and cryolite used herein are particle resources of industrial purity.

EXAMPLE 1

40 Kg of potassium chloride, 30 Kg of sodium chloride, 3 Kg of lithium chloride measured by a bench scale are put into ovens respectively and dried 4 hours at 120° C. Out of the ovens, they are ground by a ball mill respectively, afterwards they are homogeneously mixed in a ball mill.

1.5 Kg dihydrate of potassium fluoride is measured by a bench scale and ground with a plastic bar within a plastic container and produce a mixture of fine particles and aqueous solution. This mixture is added in and homogeneously mixed with the mixture prepared by previous step.

Finally, 0.5 Kg of anhydrous sodium hydrosulfate is measured by a bench scale and ground with a plastic bar within a plastic container, then it is added in and homogeneously mixed with the above mentioned mixture of 4 components. Thereby prepared 75 Kg of highly efficient covering flux for smelting aluminum (sample 1) presents an appearance of loose powder.

EXAMPLE 2

48 Kg of potassium chloride, 38 Kg of sodium chloride, 5 Kg of lithium chloride are measure by bench scale and put into ovens respectively and dried 3 hours at 200° C. Out of the ovens, they are ground by a ball mill respectively and screened through an 80mesh-sieve, afterwards they are homogeneously mixed in a ball mill.

2 Kg of dihydrate of potassium fluoride measured by a bench scale and 0.58 Kg of water are put into a plastic container. Then they are ground and stirred in order to virtually dissolve potassium fluoride. Then the obtained aqueous solution is sprayed on the mixed powders of potassium chloride, sodium chloride and lithium chloride. Afterwards the obtained mixture is homogeneously mixed.

Finally, 1 Kg monohydrate of sodium hydrosulfate measured by a bench scale and 3.5 Kg of water are put into a plastic container. Then they are ground and stirred in order to virtually dissolve sodium hydrosulfate. Afterwards the obtained aqueous solution is sprayed on and homogeneously mixed with the mixture of potassium chloride, sodium chloride, lithium chloride and lithium fluoride. Thereby prepared 94 Kg of highly efficient covering flux for smelting aluminum (sample 2), therein weight of water excluded, presents an appearance of loose, wet powder.

EXAMPLE 3

50 Kg of potassium chloride, 40 Kg of sodium chloride, 6.3 Kg of lithium chloride measured by a bench scale are put into an oven respectively and dried 2 hours at 230° C. Out of oven, they are ground and homogeneously mixed in a ball mill. Afterwards they are screened through an 80-mesh-sieve.

2.5 Kg of anhydrous potassium fluoride measured by a bench scale and 0.75 Kg water are put into a plastic container. Then they are ground and stirred in order to virtually dissolve potassium fluoride. Then the obtained aqueous solution is sprayed on the mixed powders of potassium chloride, sodium chloride, lithium chloride. Afterwards the obtained mixture is homogeneously mixed.

Finally, 1.2 Kg monohydrate of sodium hydrosulfate measured by a bench scale is ground with a plastic bar within a plastic container. Thereafter, it is added to the mixture prepared by the previous step and homogeneously mixed. Thereby prepared 100 Kg of highly efficient covering flux for smelting aluminum (sample 3), therein weight of water excluded, presents an appearance of loose, wet powder.

EXAMPLE 4

55 Kg of potassium chloride, 45 Kg of sodium chloride, 20 Kg of lithium chloride measured by a bench scale are put into an oven respectively and dried 4 hours at 120° C. Out of oven, they are ground by a ball mill and screened through an 80-mesh-sieve. Afterwards, they are homogeneously mixed.

3 Kg of anhydrous sodium hydrosulfate measured by a bench scale is ground with a plastic bar within a plastic container. Then it's homogeneously mixed with the mixture of potassium chloride, sodium chloride and lithium chloride.

Finally 5 Kg of dihydrate of potassium fluoride measured by a bench scale is ground with a plastic bar within a plastic container and then a mixture of fine particles and aqueous solution is prepared. Afterwards, this mixture is added into and homogeneously stirred with the mixture of potassium chloride, sodium chloride, lithium chloride and sodium hydrosulfate. Thereby prepared 128 Kg of covering flux for smelting aluminum (sample 4) presents an appearance of loose powder.

EXAMPLE 5

52 Kg of potassium chloride, 42 Kg of sodium chloride, 7 Kg of lithium chloride measured by a bench scale are put into an oven respectively and dried 3 hours at 200° C. Out of oven, they are ground and homogeneously mixed in a ball mill. Afterwards they are screened through an 80-mesh-sieve.

1.5 Kg monohydrate of sodium hydrosulfate measured by a bench scale and 5.1 Kg of water are put into a plastic container and ground and stirred in order to virtually dissolve sodium hydrosulfate. Then the obtained aqueous solution is sprayed on and homogeneously mixed with the mixture of potassium chloride, sodium chloride, lithium chloride.

Finally 3 Kg of dihydrate of potassium fluoride measured by a bench scale and 0.9 Kg of water are put into a plastic container and ground and stirred in order to virtually dissolve potassium fluoride. Thereafter, the obtained aqueous solution is sprayed on and homogeneously mixed with the mixtures of potassium chloride, sodium chloride, lithium chloride and sodium hydrosulfate. Thereby prepared 105.5 Kg of highly efficient covering flux for smelting aluminum (sample 5), therein weight of water excluded, presents an appearance of loose and wet powder.

EXAMPLE 6

28 Kg of potassium chloride, 68 Kg of sodium chloride, 16 Kg of lithium chloride measured by a bench scale are put into an oven respectively and dried 3 hours at 200° C. Out of oven, they are ground and homogeneously mixed in a ball mill.

0.5 Kg of anhydrous potassium fluoride measured by a bench scale is ground with a plastic bar within a plastic container. Afterwards, it's homogeneously mixed with the mixture prepared by the previous step.

Finally, 0.3 Kg of anhydrous sodium hydrosulfate measured by a bench scale is ground with a plastic bar within a plastic container. Thereafter, it is added to and homogeneously mixed with the mixture prepared by the previous step. Thereby prepared 112.8 Kg of covering flux for smelting aluminum (sample 6) presents an appearance of loose powder.

EXAMPLE 7

58 Kg of potassium chloride, 25 Kg of sodium chloride, 8 Kg of lithium chloride measured by a bench scale are put into an oven respectively and dried 4 hours at 120° C. Out of oven, they are ground by a ball mill respectively and screened through an 80-mesh-sieve. Afterwards, they are homogeneously mixed.

0.4 Kg monohydrate of sodium hydrosulfate measured by a bench scale is ground with a plastic bar within a plastic container. Then it is added into and homogeneously mixed with the mixture prepared by the previous step.

Finally 0.6 Kg of anhydrous potassium fluoride measured by a bench scale and 0.4 Kg of water are put into a plastic container and ground and stirred in order to virtually dissolve potassium fluoride. Thereafter, the obtained aqueous solution is sprayed on and homogeneously mixed with the mixtures of potassium chloride, sodium chloride, lithium chloride and sodium hydrosulfate. Thereby prepared 92.0 Kg of covering flux for smelting aluminum (sample 7), therein weight of water excluded, presents an appearance of loose and wet powder.

EXAMPLE 8

41 Kg of potassium chloride, 57 Kg of sodium chloride, 1.2 Kg of lithium chloride measured by a bench scale are put into an oven respectively and dried 2 hours at 230° C. Out of oven, they are ground and homogeneously mixed in a ball mill. Afterwards they are screened through an 80-mesh-sieve.

1 Kg of anhydrous sodium hydrosulfate measured by a bench scale and 3.5 Kg of water are put into a plastic container and ground and stirred in order to virtually dissolve sodium hydrosulfate. Thereafter, the obtained aqueous solution is sprayed on and homogeneously mixed with the mixture prepared by the previous step.

Finally 1.5 Kg dihydrate of potassium fluoride measured by a bench scale is ground with a plastic bar within a plastic container and then a mixture of fine particles and aqueous solution (a supersaturated solution) is prepared. Afterwards, this mixture is added into and homogeneously stirred with the mixture prepared by the previous step. Thereby prepared 101.7 Kg of covering flux for smelting aluminum (sample 7), therein weight of water excluded, presents an appearance of loose and wet powder.

EXAMPLE 9

The present example relates to the results of aluminum smelting experiment in laboratory using the covering flux for smelting aluminum prepared from examples 1–5. The aluminum used in this experiment is 0.007 mm-thick waste aluminum ($A_o$) foil rolled 6 days ago. The used furnace is a 7.5 KVA well-type furnace, 250 mm in diameter and 370 mm in depth. The adopted graphite crucible, 190 mm in diameter and 270 mm in depth, can contain 6 Kg aluminum.

In this experiment, the crucible is put in the furnace in advance. After the temperature is raised to 910° C. for a certain period of time, the said covering flux of present invention is sprayed into the crucible (as base layer) immediately after the door of the furnace is opened, then 2000 grams of aluminum foil is load into the crucible, and 126 grams of covering flux of present invention (as covering) is sprayed and laid on the aluminum foils. The door of the furnace is closed and aluminum is collected as ingot after 25 minutes of smelting. The actual weights of aluminum ingot obtained in various experiments are listed in Table 1.

TABLE 1

| Type of Flux Covering | Sample 1 | Sample 2 | Sample 3 | Sample 4 | Sample 5 |
|---|---|---|---|---|---|
| Weight of Al Foil Feed (g) | 2000 | 2000 | 2000 | 2000 | 2000 |
| Actual Weight of Al Ingot (g) | 1950 | 1970 | 1965 | 1956 | 1962 |
| Yield Ratio (%) | 97.5 | 98.5 | 98.3 | 97.8 | 98.1 |

From Table 1, it can be found that, using the covering flux of present invention, all the yield ratios of aluminum are around 98%, namely, an excellent result is achieved.

EXAMPLE 10

The present example relates to the experiment of recovering alumilum in an industrial smelting furnace using the covering flux for smelting aluminums prepared from example 2.

The experiment is carried out in an electrical aluminum smelting furnace with a capacity of 300 Kg. When the furnace's temperature stays at 850° C., 7 Kg of covering flux for smelting aluminum of present invention (sample 2), which accounts for 3.5% of the total feed, is evenly sprayed and laid on the bottom of the furnace. And then, 200 Kg of milling scraps of Al—Zn—Mg alloy are added at one time. Finally, 11 Kg of covering flux for smelting aluminum (sample 2), which accounts for 5.5% of the total feed, is homogeneously covered on the aluminum scraps. Then the door of the furnace is closed and the scraps are smelted for 3 hours. Totally 184 Kg of aluminum alloy ingot is obtained and the yield ratio is up to 92%.

COMPARATIVE EXAMPLE 1

In the present comparative example, 100 Kg of conventional covering flux for smelting aluminum, comprising three components of potassium chloride-sodium chloride-cryolite, is prepared at first. The composition of the said flux (parts by weight) is: potassium chloride 57, sodium chloride 38, cryolite 5. And 57 Kg of potassium chloride, 38 Kg of sodium chloride measured by a bench scale are put into an oven and dried 4 hours at 120° C. Out of oven, they are ground and homogeneously mixed in a ball mill. Afterwards they are screen through an 80-mesh-sieve. 5 Kg of cryolite is ground and homogeneously mixed with the mixture of potassium chloride and sodium chloride. In this way, the covering flux for smelting aluminum of the comparative example 1 is prepared (comparative sample 1).

This conventional covering flux is experimented in industrial smelting furnace to check its effectiveness in the following way.

The same electrical aluminum smelting furnace used in example 10, with the capacity of 300 Kg, is adopted. When the furnace's temperature stays at 850° C., 8 Kg of covering flux for smelting aluminum (comparative sample 1) which accounts for 4% of the total feed, is evenly sprayed and laid on the bottom of furnace. And then, 200 Kg of milling scraps of Al—Zn—Mg alloy is added at one time. Finally, 12 Kg of covering flux for smelting aluminum (comparative sample 1), which accounts for 6% of the total feed, is homogeneously covered on the aluminum scraps. And the door of the furnace is closed and the scraps are smelted for 3 hours. 64 Kg of aluminum alloy ingot is obtained and the yield ratio is only 32%.

From the results of Example 10 and comparative example 1, it can be found that, compared with the conventional covering flux for smelting aluminum, the covering flux for smelting aluminum of present invention can notably increase the yield of smelting aluminum or its alloys in the case of net feed, indicating the outstanding effectiveness of the covering flux for smelting aluminum of present invention.

It shall be understood that, what is described in example 9 is only one method of using the covering flux of present invention. When the smelting is carried out by dipping the compressed aluminum scraps in molten aluminum, the covering flux of present invention can be coated on the compressed aluminum scraps which are dipped in molten aluminum after being slightly dried.

The dosage of the covering flux for smelting aluminum of present invention is around 1–15% (by weight), preferably 7–9% (by weight), of the quantity of aluminum materials to be put in the furnace. As the final step for preparing the covering flux of present invention, the conventional additives included in the covering flux for smelting aluminums, e.g., barium chloride, magnesium chrolide, zinc chloride, cryolite and calcium fluoride, can be added to the said covering flux for smelting aluminum. As the covering flux of present invention is easy to absorb moisture and to deliquesce, it should be used immediately after preparation; otherwise, it's better to be stored in sealed plastic bags.

The present invention is described in details with reference to the examples. However, these examples are intended to explain the present invention, and not to restrict it in any way. The scope of the present invention is defined by the following claims. Many changes, modifications and variations may be made by a person skilled in the art under the light of above teachings, for example, during the preparation of present covering flux, either potassium chloride or sodium hydrosulfate can be added first; both potassium fluoride and sodium hydrosulfate can be added in the form of particles or in the form of aqueous solution; or one of them can be added in the form of particles and the other can be added in the form of aqueous solution, all of these are within the scope of the present invention.

I claim:

1. A covering flux for smelting aluminum comprising potassium chloride, sodium chloride, lithium chloride, potassium fluoride and sodium hydrosulfate.

2. The covering flux for smelting aluminum according to claim 1, wherein potassium fluoride is the dihydrate of potassium fluoride, and/or sodium hydrosulfate is the monohydrate of sodium hydrosulfate.

3. The covering flux for smelting aluminum according to claim 1, wherein the composition of the flux is: potassium chloride, 20–65 parts by weight; sodium chloride, 20–65 parts by weight; lithium chloride, 1–20 parts by weight; potassium fluoride, 0.3–5 parts by weight; sodium hydrosulfate, 0.2–3 parts by weight.

4. The covering flux for smelting aluminum according to claim 3, wherein the composition of the flux is: potassium chloride, 40–55 parts by weight; sodium chloride, 30–45 parts by weight; lithium chloride, 3–20 parts by weight; potassium fluoride, 1.5–5 parts by weight; sodium hydrosulfate, 0.5–3 parts by weight.

5. The covering flux for smelting aluminum according to claim 4, wherein the composition of the flux is: potassium chloride, 48–52 parts by weight; sodium chloride, 38–42 parts by weight; lithium chloride, 5–7 parts by weight; potassium fluoride, 2–3 parts by weight; sodium hydrosulfate, 1–1.5 parts by weight.

6. A process for the preparation of the covering flux for smelting aluminum comprising potassium chloride, sodium chloride, lithium chloride, potassium fluoride, sodium hydrosulfate, including the following steps:

(1) On the weight basis, each component of the covering flux for smelting aluminum: potassium chloride, sodium chloride, lithium chloride, potassium fluoride, sodium hydrosulfate, is measured by a bench scale respectively;

(2) Three components: potassium chloride, sodium chloride and lithium chloride, are dried at a temperature lower than 300° C.;

(3) These three dried components are ground and homogeneously mixed with each other;

(4) The potassium fluoride, after being ground, is homogeneously mixed with the mixture prepared from step (3);

(5) The sodium hydrosulfate, after being ground, is homogeneously mixed with the mixture prepared from step (4).

7. A process for the preparation of an covering flux for smelting aluminum according to claim 6, wherein the step (3) is: the three dried components are ground and screened through an 80-mesh-sieve, and then they are homogeneously mixed with each other.

8. A process for the preparation of an covering flux for smelting aluminum according to claim 6, wherein the step (4) is: potassium fluoride is ground and dissolved into water to prepare an aqueous solution, afterwards it is homogeneously mixed with the powder mixture prepared from step (3).

9. A process for the preparation of an covering flux for smelting aluminum according to claim 8, wherein the step (5) is: sodium hydrosulfate is ground and dissolved into water to prepare an aqueous solution, afterwards it is homogeneously mixed with the mixture prepared from step (4).

10. A process for the preparation of an covering flux for smelting aluminum according to claim 6, wherein the step (5) is: sodium hydrosulfate is ground and dissolved into water to prepare an aqueous solution, afterwards it is homogeneously mixed with the mixture from step (4).

11. A process for the preparation of an covering flux for smelting aluminum according to claim 10, wherein the step (4) is: potassium fluoride is ground and dissolved into water to prepare an aqueous solution, afterwards it is homogeneously mixed with the powder mixture prepared from step (3).

12. A process for the preparation of an covering flux for smelting aluminum comprising potassium chloride, sodium chloride, lithium chloride, potassium fluoride, sodium hydrosulfate, comprising the following steps:

(1) On the weight basis, each component of the covering flux for smelting aluminum: potassium chloride, sodium chloride, lithium chloride, potassium fluoride, sodium hydrosulfate, is measured by a bench scale respectively;

(2) Three components: potassium chloride, sodium chloride and lithium chloride, are dried at a temperature lower than 300° C.;

(3) These three dried components are ground and homogeneously mixed with each other;

(4) The sodium hydrosulfate, after being ground, is homogeneously mixed with the mixture prepared from step (3);

(5) The potassium fluoride, after being ground, is homogeneously mixed with the mixture prepared from step (4).

13. A process for the preparation of an covering flux for smelting aluminum according to claim 12, wherein the step (3) is: the three dried components are ground and screened through an 80-mesh-sieve, and afterwards they are homogeneously mixed with each other.

14. A process for the preparation of an covering flux for smelting aluminum according to claim 12, wherein the step (5) is: potassium fluoride is ground and dissolved into water to prepare an aqueous solution, afterwards it is homogeneously mixed with the mixture prepared from step (4).

15. A process for the preparation of an covering flux for smelting aluminum according to claim 14, wherein the step (4) is: sodium hydrosulfate is ground and dissolved into water to prepare an aqueous solution, afterwards it is homogeneously mixed with the powder mixture prepared from step (3).

16. A process for the preparation of an covering flux for smelting aluminum according to claim 12, wherein the step (4) is: sodium hydrosulfate is ground and dissolved into water to prepare an aqueous solution, afterwards it is homogeneously mixed with the powder mixture prepared from step (3).

17. A process for the preparation of an covering flux for smelting aluminum according to claim 16, wherein the step (5) is: potassium fluoride is ground and dissolved into water to prepare an aqueous solution, afterwards it is homogeneously mixed with the mixture prepared from step (4).

18. The covering flux for smelting aluminum according to claim 2, wherein the composition of the flux is: potassium chloride, 20–65 parts by weight; sodium chloride, 20–65 parts by weight; lithium chloride, 1–20 parts by weight; potassium fluoride, 0.3–5 parts by weight; sodium hydrosulfate, 0.2–3 parts by weight.

19. A process for the preparation of a covering flux for smelting aluminum according to claim 7, wherein the step (4) is: potassium fluoride is ground and dissolved into water to prepare an aqueous solution, afterwards it is homogeneously mixed with the powder mixture prepared from step (3).

20. A process for the preparation of a covering flux for smelting aluminum according to claim 13, wherein the step (5) is: potassium fluoride is ground and dissolved into water to prepare an aqueous solution, afterwards it is homogeneously mixed with the mixture prepared from step (4).

* * * * *

UNITED STATES PATENT AND TRADEMARK OFFICE

CERTIFICATE OF CORRECTION

PATENT NO. : 5,762,722
DATED : June 9, 1998
INVENTOR(S) : Zhang

It is certified that error appears in the above-identified patent and that said Letters Patent is hereby corrected as shown below:

Column 1,
Line 18, "ect." should be -- etc. --.
Line 63, delete "which on one" and substitute -- which, on the one hand conserves --.
Line 64, delete "is consumed,".
Line 63, after "energy" insert -- and --.
Line 65, delete "it will have" and insert -- these processes demonstrate --.
Line 66, after "with" insert -- the --.

Column 2,
Line 10, after "of" insert -- the --; and delete ", and as"; and insert -- . As -- before "this".
Lines 12-13, delete "; even" and insert -- . Even --
Lines 15, 19, 23, 37, 42, 47 and 52, after "of" insert -- the --
Line 20, delete colon.
Line 21, after "fluoride," insert -- and --.
Line 29, after "comprise" insert -- a --.
Line 32, delete "magnesium" and substitute -- magnesium --; and delete "; the" and insert -- . The --.
Line 34, delete "; and to" and insert -- to --.
Line 36, delete "; etc."
Line 39, "is:" delete colon.
Lines 44 and 49, delete colon after "is".
Line 52, delete "said".
Line 54, delete "each" and substitute -- each --.
Line 58, delete ", potassium" and substitute -- (potassium --.
Line 59, delete "chloride," and substitute -- chloride) --.
Line 60, after "(3)" insert -- the --.
Line 64, after "(3);" insert -- and --.
Line 66, after "with" insert -- the --.

UNITED STATES PATENT AND TRADEMARK OFFICE

CERTIFICATE OF CORRECTION

PATENT NO. : 5,762,722
DATED : June 9, 1998
INVENTOR(S) : Zhang

It is certified that error appears in the above-identified patent and that said Letters Patent is hereby corrected as shown below:

Column 3,
Lines 1, 2, 21, 22, 27, 28, 29, 36, 42 and 67, after "of" insert -- the --.
Line 4, delete "each" and substitute -- each --.
Line 8, delete ", potassium" and substitute -- (potassium --.
Line 9, delete "chloride," and substutitute -- chloride) --.
Line 10, after "(3)" insert -- the --.
Line 11, after "screen" should be -- screened --.
Line 18, delete "the"; and delete colon after "be".
Line 19, "is" and insert -- being -- therefor.
Line 20, 25 and 41, after "with" insert -- the --.
Line 30, after "chloride," insert -- and --.
Line 33, delete ", and then" and insert -- following this, --.
Line 45, after "on" insert -- the --.
Line 48, delete "; and on" and insert -- . On --.
Line 52, "alloys;" should be -- alloys, --.
Line 54, delete "said".
Line 55, after "aluminum" and insert -- according to the present invention --.
Line 56, delete "; even" and insert -- . Even --.

Column 4,
Lines 8-9 and 13, "Kg" all occurences should be -- kg --.
Line 15, delete "and produce" and insert -- , which produces --.
Line 17, after "by" insert -- the --.
Lines 18, 22, 28, 33, 34, 40, 41, 47, 54, 59, 60 and 66, "Kg" should be -- kg --.
Line 20, delete "it is".
Line 22, after "Thereby" insert -- the --.
Line 27 and 53, "Kg" should be -- kg -- all occurrences; and after "chloride," insert -- and --.
Line 28, "measure" should be -- measured --.
Line 31, "80 mesh-sieve" should be -- 80-mesh sieve, and --.
Line 36, after "dissolve" insert -- the --; and delete "Then the" and substitute -- The --.
Line 37, after "is" insert -- then --.
Line 46, after "Thereby" insert -- the --.
Line 56, after "of" insert -- the --.
Lines 57-58, "mesh-sieve" should be -- mesh sieve --.
Line 64, after "chloride," insert -- and --.

UNITED STATES PATENT AND TRADEMARK OFFICE

CERTIFICATE OF CORRECTION

PATENT NO. : 5,762,722
DATED : June 9, 1998
INVENTOR(S) : Zhang

It is certified that error appears in the above-identified patent and that said Letters Patent is hereby corrected as shown below:

Column 5,
Line 3, after "Thereby" insert -- the --; and "Kg" should be -- kg --.
Line 10, "Kg" should be -- kg -- all occurrences; and before "20" insert -- and --.
Lines 11, 16, 20, 26, 31, 32, 37, 38, 44, 45, 51, 58, 62 and 66, "Kg" should be -- kg --.
Lines 13, 34 and 60, after "of" insert -- the --.
Lines 14 and 35-36, "mesh-sieve" should be -- mesh sieve --.
Line 18, "it's" should be -- it is --.
Line 26, after "Thereby" insert -- the --.
Line 31, before "7" insert -- and --.
Line 42, before "lithuim" insert -- and --.
Line 50, after "thereby" insert -- the --.
Line 57, "Kg" should be -- kg -- (both); and before "16" insert -- and --.
Line 64, delete "it's" and substitute -- it is --.

Column 6,
Line 3, after "Thereby" insert -- the --; and "Kg" should be -- kg --.
Line 9, "Kg" all occurrences should be -- kg --; and before "8" insert -- and --.
Lines 10, 15, 19, 20, 26, 37, 38, 43, 49 and 62, "Kg" should be -- kg --.
Lines 12, 32, and 34, after "of" insert -- the --.
Lines 13 and 35-36, "mesh-sieve" should be -- mesh sieve --.
Line 22, after "dissolve" insert -- the --.
Lines 25 and 48, after "Thereby" insert -- the --.
Line 31, "Kg" should be -- kg -- (both); and before "1.2" insert -- and --.
Line 55, after "of" insert -- an --.
Line 56, after "in" insert -- a --.
Line 59, delete "ago" and substitute -- before --.
Line 65, delete "said" and insert -- the -- after 2nd occurrence of "of"; and after "of" insert -- the --.
Line 66, after "as" insert -- a --.

UNITED STATES PATENT AND TRADEMARK OFFICE

CERTIFICATE OF CORRECTION

PATENT NO. : 5,762,722
DATED : June 9, 1998
INVENTOR(S) : Zhang

It is certified that error appears in the above-identified patent and that said Letters Patent is hereby corrected as shown below:

Column 7,
Line 1, delete "load" and substitute -- loaded --.
Lines 2, 32, 52 and 67, after "of" insert -- the --.
Line 3, delete "foils" and substitute -- foil --.
Line 4, after "as" insert -- an --.
Line 20, before "present" insert -- the --.
Line 26, "alumilum" should be -- aluminum --.
Lines 30, 31, 34, 36, 40, 45, 54, 63, 64 and 67, "Kg" should be -- kg --.
Line 49, "is:" delete colon.
Line 50, "Kg" should be -- kg -- (both).
Line 54, "screen" should be -- screened --; and "mesh-sieve" -- no hyphen --.
Line 59, after "in" insert -- an --.

Column 8,
Lines 1 and 6, "Kg" should be -- kg --.
Line 4, delete "And the" and substitute -- The --.
Lines 11, 14, 17, 20, 23, 27, 30, 40 and 41, after "of" insert -- the --.
Line 28, "aluminums" should be -- aluminum --.
Line 29, "chrolide" should be -- chloride --.
Lines 32, 42 and 44, ";" should be comma.
Line 33, "it's" should be -- it is --.
Line 34, "details" should be -- detail --.
Line 46, ", all" should be -- . All --; and after "these" insert -- modifications --.

Column 8, claim 3,
Line 60, after "weight;" insert -- and --.

Column 8, claim 4,
Line 66, before "sodium" insert -- and --; and after "weight;" insert -- and --.

Column 9, claim 5,
Line 5, before "sodium" insert -- and --;

Column 9, claim 6,
Lines 9 and 13, before "sodium" insert -- and --.
Line 24, after "(3);" insert -- and --.

UNITED STATES PATENT AND TRADEMARK OFFICE

CERTIFICATE OF CORRECTION

PATENT NO. : 5,762,722
DATED : June 9, 1998
INVENTOR(S) : Zhang

It is certified that error appears in the above-identified patent and that said Letters Patent is hereby corrected as shown below:

Column 9, claim 7,
Line 28, "an" should be -- a --.
Line 29, delete "The".
Line 31, "80-mesh-sieve" should be -- 80-mesh sieve --.

Column 9, claim 8,
Line 33, "an" should be -- a --.
Line 34, delete "the".

Column 9, claim 9,
Line 39, "an" should be -- a --.
Line 40, delete "the".

Column 9, claim 10,
Line 44, "an" should be -- a --.
Line 45, delete "the".

Column 9, claim 11,
Line 49, "an" should be -- a --.
Line 50, delete "the".

Column 9, claim 12,
Line 55, "an" should be -- a --.
Line 57, before "sodium" insert -- and --.

Column 10, claim 12,
Line 1, before "sodium" insert -- and --.
Line 11, "after "(3);" insert -- and --.

Column 10, claim 13,
Line 15, delete "the".
Line 18, after "mesh" remove hyphen.

Column 10, claim 14,
Line 20, "an" should be -- a --.
Line 21, delete "the".

UNITED STATES PATENT AND TRADEMARK OFFICE

CERTIFICATE OF CORRECTION

PATENT NO. : 5,762,722
DATED : June 9, 1998
INVENTOR(S) : Zhang

It is certified that error appears in the above-identified patent and that said Letters Patent is hereby corrected as shown below:

Column 10, claim 15,
Line 25, "an" should be -- a --.
Line 26, delete "the".

Column 10, claim 16,
Line 31, "an" should be -- a --.
Line 32, delete "the".

Column 10, claim 17,
Line 37, "an" should be -- a --.
Line 38, delete "the".

Column 10, claim 18,
Line 46, before "sodium" insert -- and --.

Column 10, claim 19,
Line 49, delete "the".

Column 10, claim 20,
Line 55, delete "the".

Signed and Sealed this

Twenty-sixth Day of February, 2002

*Attest:*

*Attesting Officer*

JAMES E. ROGAN
*Director of the United States Patent and Trademark Office*